US006398124B1

(12) United States Patent
Barykin et al.

(10) Patent No.: US 6,398,124 B1
(45) Date of Patent: Jun. 4, 2002

(54) POWDER INJECTION SYSTEM FOR DETONATION-OPERATED PROJECTION GUN

(75) Inventors: Georgiy Barykin, San Sebastian; Julian De Juan Landaburu; Ignacio Fagoaga Altuna, both of Hondarribia, all of (ES)

(73) Assignee: Aerostar Coating S.L. (ES)

( * ) Notice: Subject to any disclaimer, the term of this patent is extended or adjusted under 35 U.S.C. 154(b) by 0 days.

(21) Appl. No.: 09/600,940

(22) PCT Filed: Jan. 23, 1998

(86) PCT No.: PCT/ES98/00015

§ 371 (c)(1),
(2), (4) Date: Sep. 28, 2000

(87) PCT Pub. No.: WO99/37406

PCT Pub. Date: Jul. 29, 1999

(51) Int. Cl.[7] ..... B05B 17/00
(52) U.S. Cl. ..... 239/8; 239/1; 239/79; 239/81; 239/85
(58) Field of Search ..... 239/1, 79, 81, 239/85, 8

(56) References Cited

U.S. PATENT DOCUMENTS 4,231,518 A * 11/1980 Zverev et al.
4,258,091 A * 3/1981 Dudko et al.

FOREIGN PATENT DOCUMENTS

| | | |
|---|---|---|
| FR | 2588018 A1 | 4/1987 |
| GB | 2100145 A | 12/1982 |
| GB | 2192815 A | 1/1988 |
| GB | 2285062 A | 6/1995 |
| WO | WO 97/23298 | 7/1997 |

* cited by examiner

*Primary Examiner*—Lesley D. Morris
*Assistant Examiner*—Robin O. Evans
(74) *Attorney, Agent, or Firm*—Cantor Colburn LLP

(57) ABSTRACT

The powder injection system consists of a dosage chamber directly fed by a conventional powder feeder and communicated with barrel of the detonation gun through a direct conduit. In this way, the pressure wave advancing through barrel enters the communication conduit and upon reaching dosage chamber undergoes a sudden expansion, interrupting powder feeding from the continuous feeder and causing the full fluidization of powder contained in dosage chamber. The fluidized powder is suctioned to barrel where it remains until the pressure wave generated in a new detonation cycle carries it away, depositing it on the surface of the part to be coated.

16 Claims, 4 Drawing Sheets

POWDER INJECTION SYSTEM FOR DETONATION-OPERATED PROJECTION GUN

TECHNICAL FIELD

This invention relates to the field of thermal spray technologies for applying coatings, and in particular to detonation thermal spray.

BACKGROUND OF THE INVENTION

At this time, detonation spray technology is mainly used to apply coatings to workpieces exposed to severe wear, heat or corrosion and is fundamentally based on using the kinetic energy produced in the detonation of a combustible mixture of gases to deposit powdered coating materials on workpieces.

Coating materials typically used in detonation processes include powder forms of metals, metal-ceramics and ceramics and are applied to improve resistance to wear, erosion, corrosion, as thermal insulators and as electrical insulators or conductors.

Spraying by detonation is performed by spray guns which basically consist of a tubular detonation chamber, with one end closed and another open, to the latter being attached a tubular barrel. A combustion gas mixture is injected into the detonation chamber and ignition of the gas mixture is achieved with a spark plug, causing a detonation and consequently a shock or pressure wave which travels at supersonic speeds inside the chamber and then inside the barrel until it leaves through the open end of the barrel.

The coating material powder is generally injected into the barrel in front of the propagating shock wave front and is then carried out of the open end of the barrel and deposited onto a substrate or workpiece placed in front of the barrel. The impact of the coating powder onto the substrate produces a high-density coating with good adhesive characteristics.

This process is repeated cyclically until the part is adequately covered.

Powder feeders commercially available supply a continuous feeding which makes them adequate for high-velocity or plasma spray technologies. Since detonation is a discontinuous process, however, it requires discontinuous powder feeding.

Feeders used in detonation devices provide discontinuous feeding by using devices which control the amount of powder supplied to the detonation barrel in each explosion. These devices, however, are designed specifically for each type of gun, that is, they cannot be interchanged for use with other guns or in other machines which require feeding powder.

With respect to the powder measuring system employed. they can be classified in two categories:

a) Mechanical: These devices use moving mechanisms (valves, spindles, gears, etc.) to introduce constant quantities of powder in each detonation cycle. Devices of this type are described for example in U.S. Pat. NO. 3,109,680, and in European Patent 0 484 533.

These devices have the main advantage of providing precise measurements but are however of great complexity they have many components. Their reliability is low since they require periodic maintenance to maintain the precision of the measurement. Finally their productivity is low since they is are limited to low operation frequencies.

b) Pneumnatic: These devices use gas pulses synchronised with the detonation pulses to introduce the powder cyclically in the detonation barrel, with these pulses sometimes being obtained from the detonation process itself. The elegance and mechanical simplicity of these devices has contributed to their wide use despite their precision being questioned. There are also numerous Patent documents such as PCT/US96/20129 by the same authors.

These devices share the characteristic of incorporating a volume or deposit in which a limited amount of powder is stored, which, by gravity, feeds another volume or dosage chamber which feeds the detonation barrel by a gas impulse. The disadvantage of these systems is their lack of precision in the amount of powder dosed, mainly due to their difficulty, over long spray periods, of keeping stable the volume and/or pressure of the feeding deposit. This is due to the fact that part of the detonation wave enters the powder feeding deposit, pressurizing it so that the powder falls under gravity and due to the pressure existing in the deposit at each time.

In addition, since the amount of powder entering the dosage chamber cannot be perfectly controlled, the degree of fluidization produced by the impulse gas cannot be controlled either, and thus it is difficult to know precisely the amount of powder injected into the barrel.

Furthermore, since in these devices feeding from the deposit to the dosing chamber is by gravity, when the detonation gun generally handled by an industrial robot) assumes positions in which the powder deposit is not vertical, the powder will not fall into the dosage chamber continuously. Thus, it is difficult to ensure a constant feeding.

Document GB-A-2 192 815 is known in prior art, which describes a detonation coating device comprising a barrel open at one end, a gas feeding system, a blast initiating assembly and a powder bath metering unit consisting of a vertically oriented bunker changing at its lower part into a vertical tube under which, inside the barrel, a horizontal rack is located. The barrel is oriented vertically with its axis parallel to the axis of the bunker, whereas the tube is connected to the barrel through the closed butt-end of the latter.

In British Patent GB-2192815, the deposit containing the powder to be discharged is placed vertical, with the powder falling on the distribution tray under the action of gravity, which moans that the gun can only operate in positions where the deposit, the distribution duct and the tray are arranged vertically, as otherwise the powder would not be supplied. Thus, this gun cannot be used mounted on a robot arm as the latter's motion would be limited by the position of the powder deposit.

The powder is fed from a closed deposit, so that as the deposit is emptied, conditions inside it change, particularly the temperature and pressure. Thus it is not possible to ensure a control of the amount of powder introduced.

The dosing of the powder to be used in each blast cycle is determined by size and arrangement of he distribution tray, and is interrupted when the powder reaches a height in the tray which obstructs the outlet of the distribution duct, so that the gas carries the amount of powder present in the tray. Thus, there is not an exact control of the dosed amount as the tray may be more or less filled depending on the chamber conditions and on the powder.

The powder feeder is on a fixed position on the rear wall of the combustion chamber, so that it is only suitable for performing certain types of coatings. This is so because, depending on the type of coating dust employed, a specific barrel length is required, and as the dust feeder is on the rear wall the length of the gun will always be the same. Thus, for coatings which require different barrel lengths we would need a different gun, suitable for this coating. The gun of GB-2192815 is therefore quite inflexible as regards the coatings which may be obtained.

This detonation coating device is not suitable for providing good coatings with any kind of materials, but it is only appropriate for particular coatings.

SUMMARY OF THE INVENTION

The present invention fully solves the above disadvantages by using an injection system which allows employing a conventional type continuous powder feeder for feeding a detonation spray system, the powder injection being performed cyclically, in synchronization with the gun spray frequency and with great precision in the powder dosage.

The system proposed allows directly connecting the gun and the continuous powder feeder and consists of a dosage chamber which receives the continuous powder feeding and a conduit which directly communicates the chamber with the gun barrel. Consequently, in each detonation cycle, the detonation pressure wave reaches the dosage chamber, momentarily interrupting the feeding so that the ensuing suction of the detonation wave carries the powder contained in the dosage chamber,thereby injecting it into the gun barrel.

With this object the dosage chamber communicates with the gun barrel by a direct tubular conduit of small diameter, so that the pressure wave that advances through the barrel passes to the communication conduit and on reaching the dosage chamber undergoes a sudden expansion which fills the chamber with pressurized gas, blocking the entry of the powder feeding conduit. In this way, the feeding of powder from the continuous feeder is cyclically interrupted, and it is therefore possible to determine the exact amount of powder present in the dosage chamber at the time of detonation.

The sudden expansion of the gas in the dosage chamber creates a turbulence which produces the fluidization of all the powder contained in the dosage chamber so that the suction process, which follows the detonation, carries all the powder contained in the chamber, so that it is possible to control the exact amount of powder injected into the barrel. In addition, as the pressure wave is composed of hot gases produced in the combustion process the interaction of these gases with the powder contained in the dosage chamber produces a preheating of the powder which favors its fluidization.

In this way, when the pressure wave generated in the detonation passes the communication conduit of the dosage chamber, the low pressure generated after the detonation wave creates a suction which carries the gas contained in the dosage chamber and the fluidized powder. The powder carried reaches the barrel, where it remains until the pressure wave generated in the following detonation cycle carries it, depositing it on the surface of the part to be coated.

With this injection system the pressure wave from the detonation is made to perform the injection of powder into the barrel cyclically and synchronized with the gun firing frequency, thus transforming a continuous powder feeding into a pulsed injection to the gun barrel without using complex mechanical devices.

In addition, the expansion created by the dosage chamber reduces the velocity of the pressure wave preventing it from eroding the dosage chamber and advancing into the powder feeder, eliminating the risk of it producing irreparable damages to the feeding system.

The dosage chamber presents an elongation or auxiliary chamber opposite the communication conduit to the detonation barrel which is meant to increase the length of the dosage chamber to reduce the force of the impact and therefore the effects of the erosion produced by the encounter of the gases and the powder in this area of the dosage chamber.

The device of the invention presents the following advantages:

- It favors a cyclical interruption of the feeding by the detonation pressure wave.
- It favors a preheating and fluidization of the powder by its interaction with the hot gases of the combustion.
- It allows feeding a precise amount of powder in each explosion by the suction effect which follows the pressure wave in each detonation.

BRIEF OF THE DRAWINGS

To complement the description being made and in order to aid a better understanding of the characteristics of the invention, attached to the present descriptive memory and as an integral part of the same is a set of drawings where, with an illustrative and non-limiting nature, the following has been shown:

DETAILED DESCRIPTION OF THE PREFERRED EMBODIMENT

Figure 1:
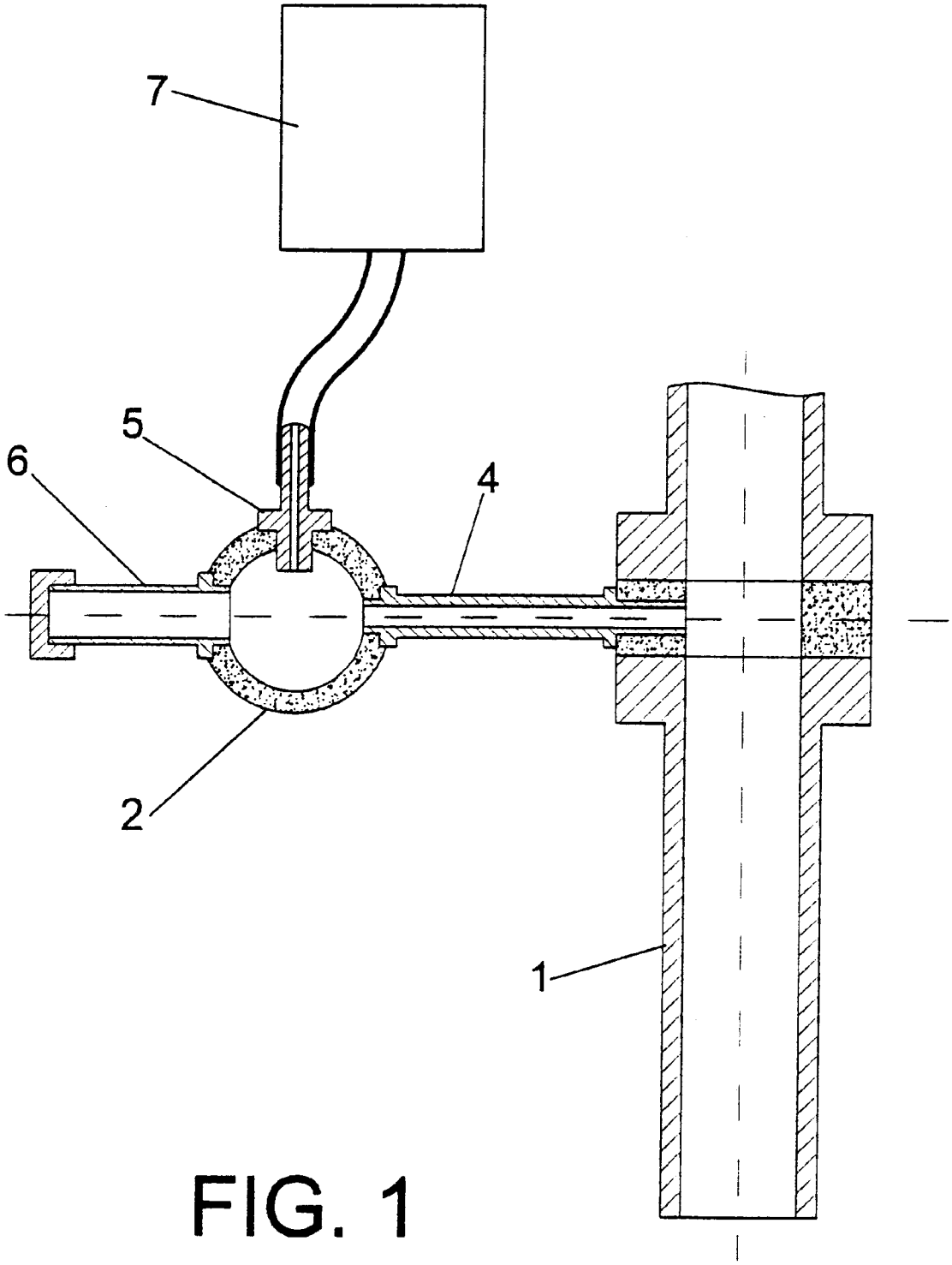
FIG. 1 shows a sketch of the powder injection device of the invention.

As shown in FIG. 1 the system of the invention is a connection device between a continuous feeding system and a detonation gun and basically consists of an expansion and dosage chamber (2) which 10 is reached by a direct conduct (5) by the powder supplied by a continuous feeding system (7), not shown, the dosage chamber (2) being connected to the barrel (1) by a direct conduit (4).

The dosage chamber (2) is basically an expansion chamber which communicates with the barrel (1) of the gun through a direct tubular conduit (4) of reduced diameter, so that the pressure wave advancing through the barrel (1) passes to the communication conduit (4) and reaches the dosage chamber (2). The detonation gases which reach the dosage chamber (2) undergo a sudden expansion which fills the chamber with gas, blocking the entry of the powder feeding conduct (5). In this way it is possible to cyclically interrupt the feeding of powder from the continuous feeder (7) and thus it is possible to control the amount of powder dosed in the chamber and consequently the amount of powder injected to the barrel in each detonation cycle.

The sudden expansion of the gas in the dosage chamber (2) creates a turbulence which produces the fluidization of all the powder contained in the dosage chamber (2), so that the auction process which follows the detonation carries all the powder contained in the chamber injecting it into the barrel (1). The fluidization of the powder contained in the dosage chamber (2) is favored by the fact that the gases of the detonation wave are at a high temperature.

In this way, when the pressure wave, generated by the detonation, passes the communication conduct (4), the low pressure generated after the detonation wave produces a suction which carries the gas contained in chamber (2) and the powder included in it (which is totally fluidized). The powder is carried to the barrel (1) where it remains until the pressure wave produced in a new detonation cycle carries it, depositing it on the substrate (3) or part to be covered. (See FIG. 2)

In addition, the expansion of gases of the detonation wave inside chamber (2) produces a reduction in their velocity, minimizing the erosion effect on the chamber (2) walls and preventing the pressure wave from advancing through conduit (5) to the powder feeding system (7).

Although expansion chamber (2) reduces the speed of the pressure wave, unavoidably there is interaction between the gases and the inner walls of the chamber in the area opposite the communication conduit (4) so that the impact of the pressurized gas and the fluidized powder against this area would inevitably result in severe erosion. For this reason, the dosage chamber is provided with an extension or auxiliary chamber (6) with an inlet point opposite communication conduit (4) so that the pressure shock wave expands inside the dosage chamber (2) and inside the extension (6) avoiding a violent collision of the shock wave with the walls of chamber (2).

The expansion chamber (2) can have any shape or size as long as the gases which enter it through conduit (4) undergo a sudden expansion as they enter the chamber. Communication conduit (4) can also have any length or diameter as long as it is great enough so that the powder does not adhere to the conduit walls, blocking it, and so that the pressure of the detonation wave which travels through the conduit (4). is not too large, that is, as long as the pressure allows fluidization of the powder contained in the chamber but does not endanger the continuous powder feeding system nor exhaust the energy available for detonation.

Figure 3:
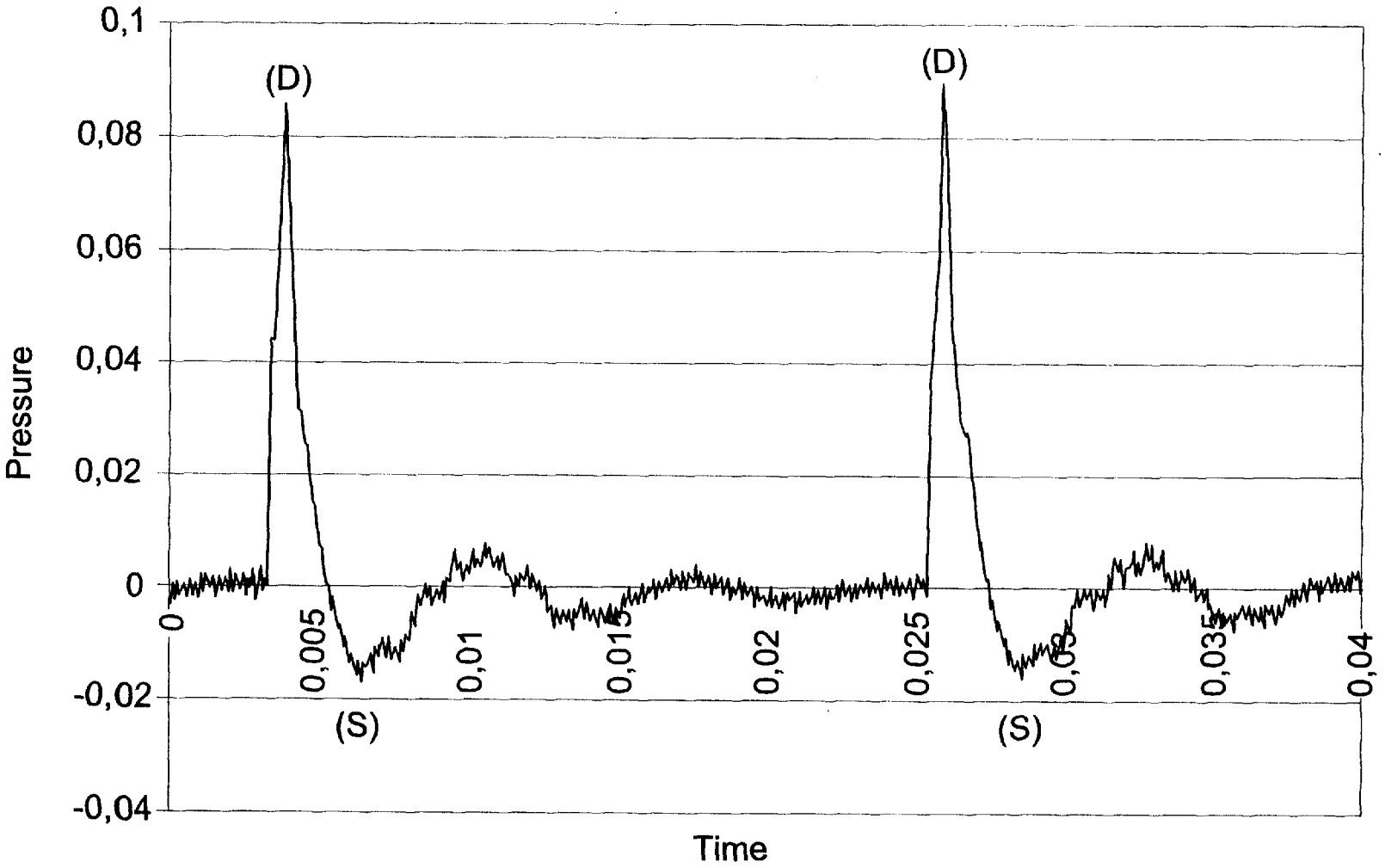
FIG. 3 shows a graph showing the evolution of pressure at the powder injection point along two firing cycles of the detonation gun.

FIG. 3 shows a graph with the pressure variations with time at the powder injection point. A peak or sudden pressure increase (D) can be clearly seen, corresponding to the detonation, followed by a pressure drop (S) corresponding to the suction following the detonation. The pressure then remains more or less constant until the following cycle when a new pressure peak (D) occurs, followed by the ensuing suction (S).

Figure 2:
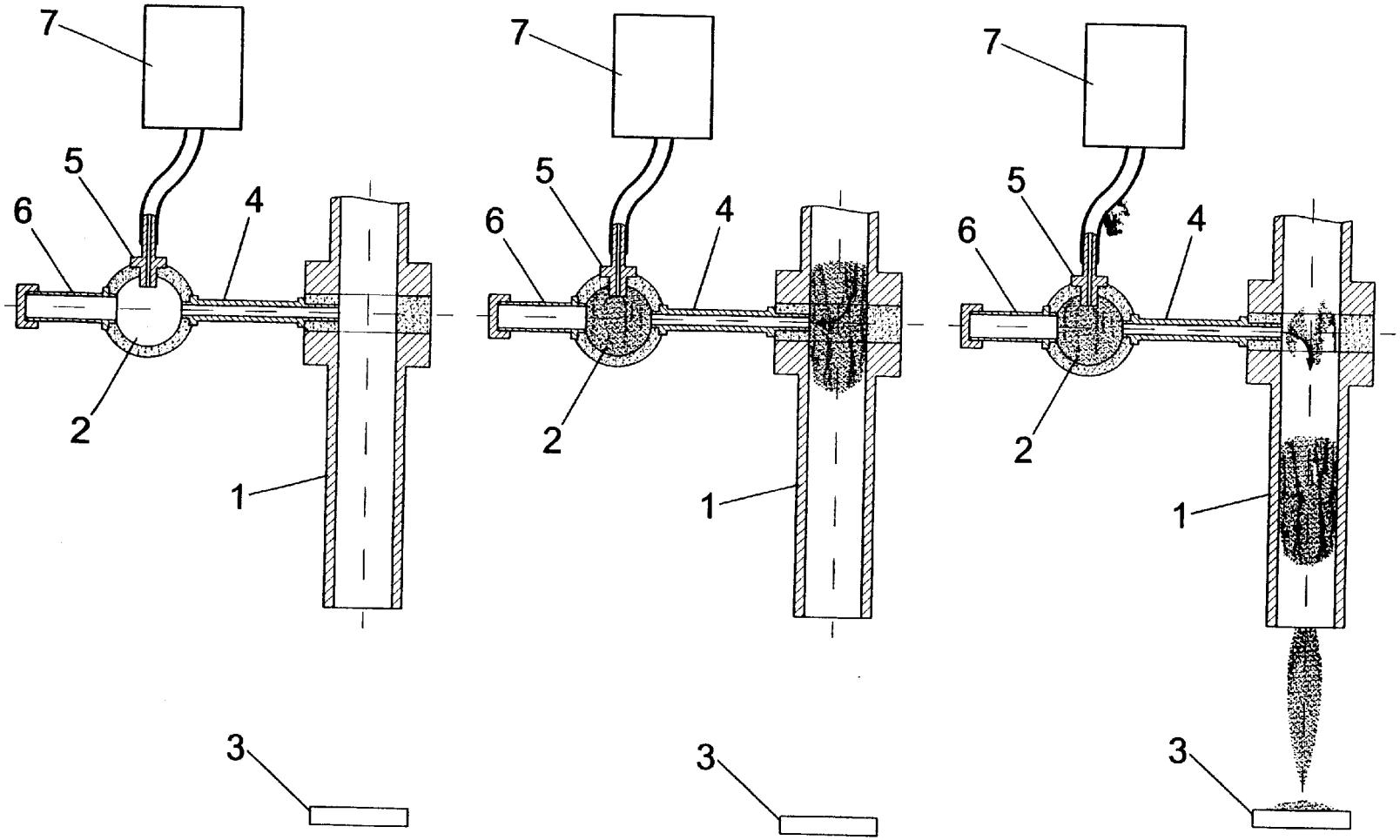
FIG. 2 shows an operation sequence of the powder injection device of the invention.

With this configuration, as seen in FIGS. 2 and 3, the operation sequence corresponding to a gun operation cycle with the injector of the invention will be the following:

A conventional continuous powder feeding system (7) supplies powder to the dosage chamber (2) via a conduit (5). This feeding occurs continuously and directly, without any valves or closing mechanisms between the powder feeding system (7) and the dosage chamber (2).

When the pressure wave (D) front reaches the communication opening between conduit (4) and barrel (1) part of the detonation gases enter through conduit (4) until they reach the dosage chamber (2). On reaching the dosage chamber (2), these gases undergo a sudden expansion which fills the dosage chamber (2) with pressurized gas, blocking entry of powder from conduit (5), and thereby converting the continuous powder feeding into a discontinuous filling of the dosage chamber.

In addition, the sudden expansion of gases generates a turbulence which causes the fluidization of all powder contained in the dosage chamber (2), the fluidization being favored by the high temperature of the detonation gases.

Once front (D) of the detonation wave has fully passed the communication orifice to the conduit (4), low pressure (S) causes a suction which carries the gases contained both in the dosage chamber (2) and in conduit (4), and therefore, the powder contained in the dosage chamber (2). In this way, the powder reaches the barrel, to await the following pressure front (D) that corresponds to the following detonation, which will carry the powder away with it. As all the powder contained in the dosage chamber (2) is fluidized, the suction generated by the pressure wave carries all the powder in the dosage chamber (2), thus obtaining a periodic and controlled injection of powder into the barrel.

Figure 4:
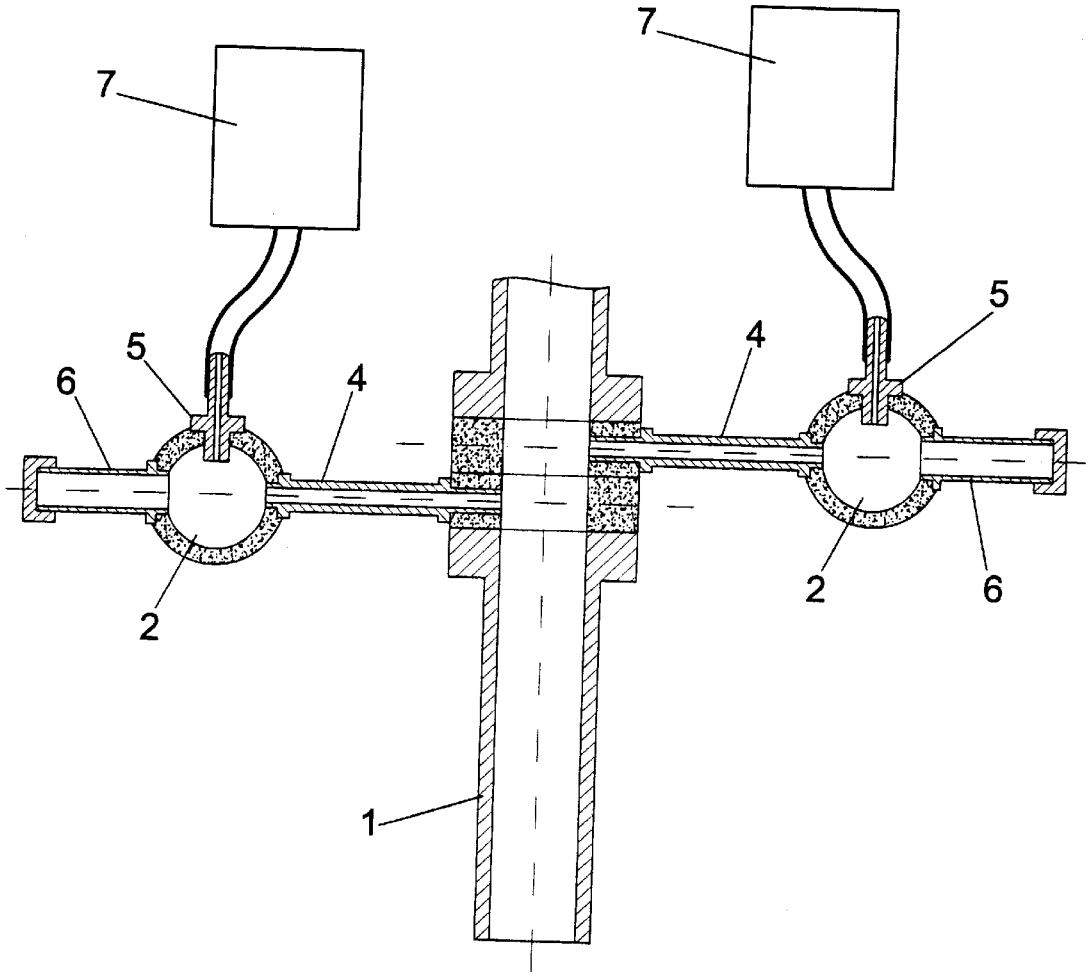
FIG. 4 shows a sketch of the embodiment with a double powder injection device.

Finally, FIG. 4 shows a double device consisting of two injection systems in order to allow feeding of different types of powders at points axially separated from the barrel to obtain multiple-layer coatings or even coatings of gradient composition.

The powder injection apparatus of the present invention, when incorporated to a detonation system, increases its precision, reliability, versatility, and productivity as compared to conventional systems.

What is claimed is:

1. A powder injection system for a detonation spray gun of the type comprising a gas supply, an ignition source, and a barrel, the system comprising:

an expansion and dosage chamber directly fed by a continuous powder feeding device; and means for communicating with the dosage chamber and the barrel, the means being disposed so that a first pressure associated with gases traveling down the barrel, when reaching the dosage chamber, temporarily interrupts powder feeding until a subsequent lower second pressure sucks powder contained in the chamber to the barrel.

2. A powder injection system for a detonation spray gun as claimed in claim 1, wherein the communication conduit has a reduced diameter, so that the gases which advance through the communication conduit undergo expansion on reaching the dosage chamber.

3. A powder injection system for a detonation spray gun as claimed in claim 1, wherein the carrier gas supply is a continuous supply.

4. A powder injection system for a detonation spray gun as claimed in claim 1, wherein the communication conduit has a sufficiently large diameter to prevent powder from adhering to inner walls of the communication conduit.

5. A powder injection system for a detonation spray gun as claimed in claim 1, wherein the barrel has an axis and the conduit is disposed radially about the axis.

6. A powder injection system for a detonation spray gun as claimed in claim 1, wherein the powder feeding device further comprises a carrier gas supply.

7. A powder injection system for a detonation spray gun of the type comprising a gas supply, an ignition source, and a barrel, the system comprising:

an expansion and dosage chamber directly fed by a continuous powder feeding device, wherein the expansion and dosage chamber incorporates an extension or auxiliary chamber which increases the length of the dosage chamber;

a communication conduit in communication with the dosage chamber and the barrel, wherein the conduit is disposed so that a first pressure associated with gases traveling down the barrel, when reaching the dosage chamber temporarily interrupts powder feeding until a subsequent lower second pressure sucks powder contained in the chamber to the barrel.

8. A powder injection system for a detonation spray gun as claimed in claim 3, wherein the auxiliary chamber is in fluid communication with the dosage chamber at a point opposite the communication conduit.

9. A method for introducing powder to a detonation spray gun of the type comprising detonation gases supply, an ignition source, and a barrel having an open end, the method comprising:

feeding powder into an expansion and dosage chamber;

feeding detonation gases to a barrel;

igniting the detonation gases to produce a detonation pulse;

passing a portion of the detonation pulse through a communication conduit to the expansion and dosage chamber; and interrupting the feeding of powder into the chamber and drawing the powder from the chamber into the barrel with said portion of the detonation pulse.

10. A method for introducing powder to a detonation spray gun as claimed in claim 9, wherein feeding detonation gases further comprises feeding detonation gases through a communication conduit in fluid communication with the barrel.

11. A method for introducing powder to a detonation spray gun as claimed in claim 9, wherein feeding powder into the chamber further comprises using a powder feeding device to feed powder into the chamber.

12. A method for introducing powder to a detonation spray gun as claimed in claim 9, further comprising fluidising the powder in the chamber.

13. A method for introducing powder to a detonation spray gun as claimed in claim 9, wherein feeding powder into the chamber further comprises using a carrier gas.

14. A method for introducing powder to a detonation spray gun of the type comprising detonation gases supply, an ignition source, and a barrel having an open end, the method comprising:

feeding powder into an expansion and dosage chamber;

feeding detonation gases to a barrel;

igniting the detonation gases to produce a detonation pulse;

passing a portion of the detonation pulse through a communication conduit to the expansion and dosage chamber, wherein the communication conduit is in fluid communication with the expansion and dosage chamber and tho barrel, wherein the portion of the detonation pulse in the chamber interrupts the feeding of powder into the chamber, and drawing the powder from the chamber into the barrel, wherein the feeding is solely controlled by tho detonation pulse.

15. A method for introducing powder to a detonation spray gun as claimed in claim 14, wherein the interruption of feeding causes cyclical feeding of the powder to the chamber.

16. A method for introducing powder to a detonation spray gun as claimed in claim 15, wherein the igniting the detonation gases has a frequency and wherein the cyclical feeding is synchronized with the frequency.

* * * * *

UNITED STATES PATENT AND TRADEMARK OFFICE

CERTIFICATE OF CORRECTION

PATENT NO. : 6,398,124 B1
DATED : June 4, 2002
INVENTOR(S) : Barykin et al.

It is certified that error appears in the above-identified patent and that said Letters Patent is hereby corrected as shown below:

Column 1,
Line 63, after “plexity” insert -- and --.

Column 2,
Line 1, after “b)” delete “Pneumnatic” and insert -- Pneumatic --.
Line 6, after “devices” delete “has” and insert -- have --.
Line 29, after “industrial” delete “robot)” and insert -- robot --.
Line 45, after “placed” delete “vertical” and insert -- vertically --.
Line 58, after “of” delete “he” and insert -- the --.

Column 4,
Line 21, after “BRIEF” insert -- DESCRIPTION --.
Line 45, after “which” delete “10”, and after “direct” delete “conduct” and insert -- conduit --.
Line 57, after “feeding” delete “conduct” and insert -- conduit --.
Line 65, after “the” delete “auction” and insert -- suction --.

Column 5,
Line 4, after “communication” delete “conduct” and insert -- conduit --.
Line 35, after “conduit” delete “(4).” and insert -- (4) --.
Line 50, after “the” (first occurrence) delete “injector” and insert -- injection system --.

UNITED STATES PATENT AND TRADEMARK OFFICE

CERTIFICATE OF CORRECTION

PATENT NO. : 6,398,124 B1
DATED : June 4, 2002
INVENTOR(S) : Barykin et al.

It is certified that error appears in the above-identified patent and that said Letters Patent is hereby corrected as shown below:

Column 6,
Line 65, after “chamber;” insert -- and --.

Column 8,
Line 19, after “and” delete “tho” and insert -- the --.

Signed and Sealed this

Twenty-first Day of February, 2006

JON W. DUDAS
*Director of the United States Patent and Trademark Office*